US011064848B2

(12) United States Patent
Ishikawa

(10) Patent No.: US 11,064,848 B2
(45) Date of Patent: Jul. 20, 2021

(54) FILM-PACKAGED TISSUE, MANUFACTURING METHOD FOR FILM-PACKAGED TISSUE, FILM-PACKAGED TISSUE SET PACKAGE, AND MANUFACTURING METHOD FOR FILM PACKAGED TISSUE SET PACKAGE

(71) Applicant: DAIO PAPER CORPORATION, Ehime (JP)

(72) Inventor: Shigeo Ishikawa, Shizuoka (JP)

(73) Assignee: DAIO PAPER CORPORATION, Ehime (JP)

( * ) Notice: Subject to any disclaimer, the term of this patent is extended or adjusted under 35 U.S.C. 154(b) by 177 days.

(21) Appl. No.: 16/330,499

(22) PCT Filed: May 23, 2017

(86) PCT No.: PCT/JP2017/019214
§ 371 (c)(1),
(2) Date: Mar. 5, 2019

(87) PCT Pub. No.: WO2018/061311
PCT Pub. Date: Apr. 5, 2018

(65) Prior Publication Data

US 2019/0191940 A1 Jun. 27, 2019

(30) Foreign Application Priority Data

Sep. 30, 2016 (JP) ..... JP2016-195202

(51) Int. Cl.
*A47K 10/42* (2006.01)
*B65D 75/12* (2006.01)
(Continued)

(52) U.S. Cl.
CPC ..... *A47K 10/42* (2013.01); *B65B 5/06* (2013.01); *B65B 9/067* (2013.01); *B65B 9/087* (2013.01);
(Continued)

(58) Field of Classification Search
CPC ..... B65D 2205/02; B65D 77/04; B65D 5/06; B65D 83/0894; B65D 83/0805; B65D 75/5827; B65B 9/087; A47K 10/42
(Continued)

(56) References Cited

U.S. PATENT DOCUMENTS 4,420,080 A * 12/1983 Nakamura ..... B65B 61/184 206/449
4,555,017 A * 11/1985 Blackmore ..... B65D 71/08 206/499
(Continued)

FOREIGN PATENT DOCUMENTS

CN 1602276 A 3/2005
CN 203283418 U 11/2013
(Continued)

OTHER PUBLICATIONS

Communication from Examining Division dated Sep. 3, 2020 in corresponding European application No. 17855270.9; 4 pgs.
(Continued)

*Primary Examiner* — Ernesto A Grano
(74) *Attorney, Agent, or Firm* — Maier & Maier, PLLC

(57) ABSTRACT

A tissue paper package not prone to losing shape. Film-packaged tissue paper comprising a pop-up type substantially cuboid bundle of tissue paper packaged with a flexible resin packaging film, and characterized in that air vents for providing communication between the inside and the outside of the package are formed at positions on the packaging film
(Continued)

facing short-side surfaces of the bundle of tissue paper where no folded edges are arranged.

3 Claims, 5 Drawing Sheets

(51) Int. Cl.

| | |
|---|---|
| ***B65D 75/58*** | (2006.01) |
| ***B65B 9/087*** | (2012.01) |
| ***B65D 83/08*** | (2006.01) |
| ***B65B 5/06*** | (2006.01) |
| ***B65D 77/04*** | (2006.01) |
| ***B65D 85/07*** | (2017.01) |
| ***B65B 9/067*** | (2012.01) |
| ***B65D 75/52*** | (2006.01) |
| ***B65D 75/46*** | (2006.01) |
| ***B65D 81/20*** | (2006.01) |
| ***B65D 75/40*** | (2006.01) |

(52) U.S. Cl.
CPC ..... *B65D 75/12* (2013.01); *B65D 75/40* (2013.01); *B65D 75/46* (2013.01); *B65D 75/52* (2013.01); *B65D 75/5827* (2013.01); *B65D 77/04* (2013.01); *B65D 81/20* (2013.01); *B65D 83/08* (2013.01); *B65D 83/0805* (2013.01); *B65D 83/0894* (2013.01); *B65D 85/07* (2018.01); *B65D 2205/02* (2013.01)

(58) Field of Classification Search
USPC ..... 206/449
See application file for complete search history.

(56) References Cited

U.S. PATENT DOCUMENTS

| | | | | |
|---|---|---|---|---|
| 4,723,301 | A * | 2/1988 | Chang | B65D 75/5838 383/211 |
| 5,145,108 | A * | 9/1992 | Pinckney | B65B 61/14 229/117.23 |
| 5,595,786 | A * | 1/1997 | McBride, Jr. | B65D 83/0805 134/40 |
| 5,901,847 | A * | 5/1999 | Colby | B65D 71/063 206/427 |
| 5,971,153 | A * | 10/1999 | Bauer | A61F 13/5511 206/494 |
| 5,996,797 | A * | 12/1999 | Flaig | B65D 77/02 206/210 |
| 6,752,262 | B1 * | 6/2004 | Boriani | B65D 5/524 206/273 |
| 8,197,925 | B2 * | 6/2012 | Sankey | B32B 27/36 428/138 |
| 9,399,540 | B2 * | 7/2016 | Bushman | B65D 83/08 |
| 9,556,561 | B2 * | 1/2017 | Nelvig | D21H 5/00 |
| 2003/0116581 | A1 * | 6/2003 | Schmidt | B65H 45/24 221/49 |
| 2004/0124101 | A1 * | 7/2004 | Mitchell | B65D 83/0805 206/205 |
| 2004/0129592 | A1 | 7/2004 | Otsubo | |
| 2004/0245140 | A1 * | 12/2004 | Larsson | B65D 75/52 206/494 |
| 2004/0251163 | A1 | 12/2004 | Conde et al. | |
| 2005/0150785 | A1 * | 7/2005 | Julius | B65D 75/5838 206/233 |
| 2005/0207680 | A1 | 9/2005 | Schumacher et al. | |
| 2010/0243504 | A1 * | 9/2010 | Long | B65D 83/0894 206/494 |
| 2011/0052107 | A1 * | 3/2011 | Schlarp | B65D 75/5838 383/200 |
| 2011/0147239 | A1 * | 6/2011 | Arkins | G09F 3/10 206/216 |
| 2011/0210138 | A1 * | 9/2011 | Szymonski | B65D 83/0835 221/45 |
| 2012/0175280 | A1 * | 7/2012 | Bando | B65D 83/0805 206/494 |
| 2013/0272630 | A1 * | 10/2013 | Thomas | B65D 75/5805 383/201 |
| 2014/0185962 | A1 * | 7/2014 | Sanfilippo | B65D 75/5838 383/6 |
| 2014/0190859 | A1 * | 7/2014 | Yamada | B65D 75/5838 206/494 |
| 2014/0239054 | A1 | 8/2014 | Jackson et al. | |
| 2014/0314344 | A1 | 10/2014 | Kreymborg | |
| 2014/0319280 | A1 * | 10/2014 | Potter | B64D 1/08 244/137.1 |
| 2015/0001234 | A1 * | 1/2015 | Sanfilippo | B65D 75/5877 220/834 |
| 2015/0008238 | A1 * | 1/2015 | Yamada | B65D 83/0894 221/63 |
| 2016/0016665 | A1 * | 1/2016 | Potter | B64D 1/12 244/137.1 |
| 2016/0137392 | A1 * | 5/2016 | Yamada | A47K 10/20 206/494 |
| 2017/0175336 | A1 * | 6/2017 | Hirata | B65D 5/0227 |
| 2019/0029478 | A1 * | 1/2019 | Dieringer | A47K 10/16 |

FOREIGN PATENT DOCUMENTS

| | | | |
|---|---|---|---|
| DE | 36 02 850 | A1 | 9/1986 |
| DE | 202004000278 | U1 | 4/2004 |
| JP | S46-037469 | B1 | 11/1971 |
| JP | H08175503 | A | 7/1996 |
| JP | H09-142550 | A | 6/1997 |
| JP | 2001089023 | A | 4/2001 |
| JP | 2001-340257 | A | 12/2001 |
| JP | 2002067188 | A | 3/2002 |
| JP | 2007254005 | A | 10/2007 |
| JP | 2010195443 | A | 9/2010 |
| JP | 2013071748 | A | 4/2013 |
| JP | 5478092 | B2 | 4/2014 |
| JP | 2016-067757 | A | 5/2016 |
| WO | 2010/038079 | A1 | 4/2010 |
| WO | 2017/168941 | A1 | 10/2017 |

OTHER PUBLICATIONS

Office Action dated Mar. 13, 2020 in corresponding Japanese application No. 2017-213641; 7 pgs.
European Search Report dated Sep. 13, 2019 in corresponding European application No. 17855270.9; 8 pgs.
Office Action dated Oct. 8, 2019 in corresponding Chinese application No. 201780056201.5; 20 pgs.
International Search Report dated Jul. 11, 2017 and Written Opinion of corresponding application No. PCT/JP2017/019214; 8 pgs.
Office Action dated Mar. 16, 2020 in corresponding Chinese Application No. 201780056201.5; 24 pages including English-language translation.
Decision to Grant dated May 1, 2020 in corresponding Japanese Application No. 2017-213641; 4 pages including English-language translation.

* cited by examiner

FILM-PACKAGED TISSUE, MANUFACTURING METHOD FOR FILM-PACKAGED TISSUE, FILM-PACKAGED TISSUE SET PACKAGE, AND MANUFACTURING METHOD FOR FILM PACKAGED TISSUE SET PACKAGE

TECHNICAL FIELD

The present invention relates to a film-packaged tissue in which a tissue paper bundle formed by folding and stacking tissue papers is packaged with a flexible packaging film and a manufacturing method for the film-packaged tissue, and more particularly, to a film-packaged tissue set package in which a plurality of film-packaged tissues are collectively packaged and a manufacturing method for the film-packaged tissue set package.

BACKGROUND ART

As a conventional tissue paper package, a box tissue in which a tissue paper bundle is enclosed in a paper storage box called a carton box has been mainly used.

However, in recent years, a tissue paper package called a film-packaged tissue in which a tissue paper bundle is packaged with a resinous flexible packaging film has been commonly used in order to reduce the amount of packaging materials due to environmental considerations and to reduce transportation cost while improving portability due to a compact size and the sales volume thereof is rising.

However, since the film-packaged tissue has a configuration in which the bundle of the flexible tissue paper is packaged with the flexible packaging film, its shape cannot be satisfactorily maintained as compared with the box tissue.

In many cases, the tissue paper packages are generally sold in the form of collective packaging (also referred to as pack packaging) such as three packs and five packs packaged in a large number at retail stores in a piled state.

However, as those piled up in such shops, the set package of the box tissue is suitable in that the box tissue has a cuboid shape and has a certain degree of rigidity. In contrast, since those just formed by collectively packaging a plurality of flexible film-packaged tissues cannot satisfactorily maintain its shape, these tissue sets are difficult to be piled up in the shops. For this reason, although the film-packaged tissue has advantages of a compact size and a low cost, the film-packaged tissue cannot deal with mass sales of low-cost products at the shops in a piled state.

Patent Document 1: JP-A-2010-195443

SUMMARY

Therefore, a main object of the invention is to provide a film-packaged tissue which can be collectively packaged while excellently maintaining its shape and a manufacturing method for the film-packaged tissue. Moreover, the object is to provide a film-packaged tissue set package capable of excellently maintaining its shape and a manufacturing method for the film-packaged tissue set package.

Means for solving the above-described problems are as below.

A film-packaged tissue paper in which a pop-up type tissue paper bundle having a substantially cuboid shape and formed by folding and stacking a plurality of tissue papers so that the tissue paper is folded in half and outer folded sides of the other tissue papers located at upper and lower positions are located at an inner folded side is packaged with a flexible resinous packaging film, in which an air vent communicating the inside and the outside of a package is formed at a position facing a short side surface having no arranged folded edges of the tissue paper bundle of the packaging film.

A manufacturing method for a film-packaged tissue, the method including:

a tissue paper bundle forming step of forming a pop-up type tissue paper bundle having a substantially cuboid shape and formed by folding and stacking a plurality of tissue papers so that the tissue paper is folded in half and outer folded sides of the other tissue papers located at upper and lower positions are located at an inner folded side by an inter folder;

a conveying step of conveying the tissue paper bundle with a short side surface having no arranged folded edges of the tissue papers in the front to back direction;

a hole forming step of forming air vents in a continuous packaging film conveyed while being reeled out from a web roll at intervals by a die cut roll; and a packaging step of forming an individual package by positioning the tissue paper bundle between the air vents of the continuous packaging film while conveying the tissue paper bundle so that a conveying direction of the tissue paper bundle is aligned to a conveying direction of the continuous packaging film, wrapping the tissue paper bundle while wrapping edge portions of the continuous packaging film, thermally bonding the packaging film at a position where the air vent remains at a position facing the short side surface of the tissue paper bundle, and trimming the packaging film at the same timing as the thermal bonding process or after the thermal bonding process.

The manufacturing method for a film-packaged tissue according to claim 2, in which an opening perforation is formed between the air vents of the continuous packaging film by the die cut roll.

A film-packaged tissue set package which is formed such that a plurality of film-packaged tissue papers in which a pop-up type tissue paper bundle having a substantially cuboid shape and formed by folding and stacking a plurality of tissue papers so that the tissue paper is folded in half and outer folded sides of the other tissue papers located at upper and lower positions are located at an inner folded side is packaged with a flexible resinous film and in which an air vent communicating the inside and the outside of the package is formed at a position facing a short side surface having no arranged folded edges of the tissue paper bundle are provided as a film-packaged tissue set in a substantially cuboid shape so that the longitudinal side surfaces having arranged folded edge and the short side surfaces having no arranged folded edges are respectively aligned and the film-packaged tissue set is subjected to gusset packaging while being compressed in the tissue paper stacking direction.

The film-packaged tissue set package according to claim 1, in which the gusset packaging means that a handle portion is formed at one short side surface side.

A manufacturing method for a film-packaged tissue set package, the method including:

a tissue paper bundle forming step of forming a pop-up type tissue paper bundle having a substantially cuboid shape and formed by folding and stacking a plurality of tissue papers so that the tissue paper is folded in half and outer folded sides of the other tissue papers located at upper and lower positions are located at an inner folded side by an inter folder;

a conveying step of conveying the tissue paper bundle with a short side surface having no arranged folded edges of the tissue papers in the front to back direction;

a hole forming step of forming air vents in a continuous packaging film conveyed while being reeled out from a web roll at intervals by a die cut roll;

a packaging step of forming an individual package by positioning the tissue paper bundle between the air vents of the continuous packaging film while conveying the tissue paper bundle so that a conveying direction of the tissue paper bundle is aligned to a conveying direction of the continuous packaging film, wrapping the tissue paper bundle while wrapping edge portions of the continuous packaging film, thermally bonding the packaging film at a position where the air vent remains at a position facing the short side surface of the tissue paper bundle, and trimming the packaging film at the same timing as the thermal bonding process or after the thermal bonding process;

a step of forming a film-packaged tissue set having a substantially cuboid shape by disposing a plurality of film-packaged tissues having the air vents formed at a position facing the packaged short side surface so that longitudinal side surfaces having arranged folded edges and short side surfaces having no folded edges are respectively flush with one another;

a compression step of compressing the film-packaged tissue set in the tissue paper stacking direction by bringing a pressing member into contact with a pair of film-packaged tissues located at both ends of the film-packaged tissue set to discharge air inside the package to the outside from the air vents formed in the film-packaged tissues; and a gusset packaging step of performing gusset packaging on the film-packaged tissue set compressed in the tissue paper stacking direction by inserting the film-packaged tissue set compressed in the tissue paper stacking direction into an one-side closed bag or a tubular film with both end openings which is a precursor of a gusset packaging bag of a size in which the compressed state is maintained and sealing the opening of the bag or the tubular film.

According to the above-described invention, it is possible to provide a film-packaged tissue which can be collectively packaged while excellently maintaining its shape and a manufacturing method for the film-packaged tissue. Moreover, it is possible to provide a film-packaged tissue set package which can excellently maintain its shape and a manufacturing method for the film-packaged tissue set package.

DETAILED DESCRIPTION

Figure 1:
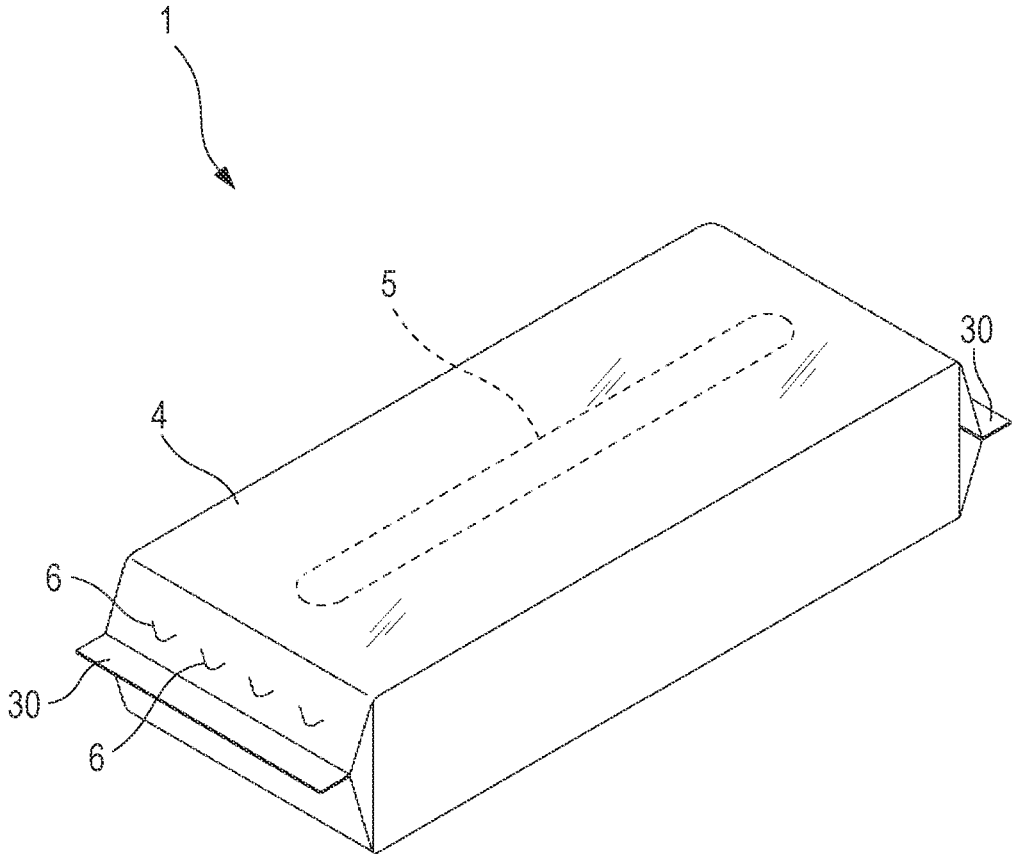
FIG. 1 is a perspective view of a film-packaged tissue of the invention.
Figure 2:
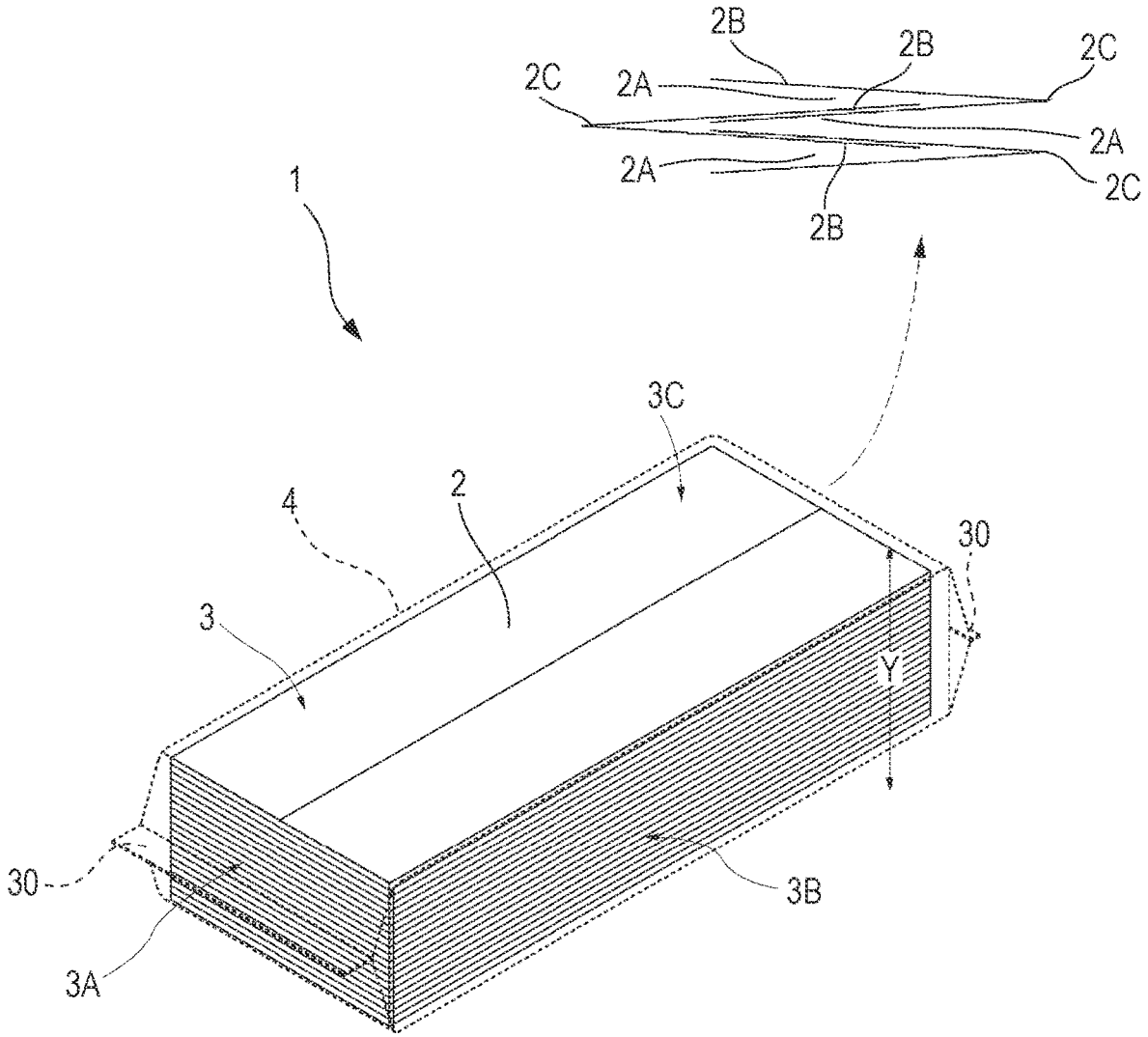
FIG. 2 is a perspective view illustrating a tissue paper bundle according to the invention.

Hereinafter, an embodiment of the invention will be described with reference to FIGS. 1 to 5.

A film-packaged tissue 1 according to the invention means that a tissue paper bundle formed by folding and stacking a plurality of sets of tissue papers 2 is packaged with a flexible resinous packaging film 4.

The tissue paper bundle 3 which is enclosed in the film-packaged tissue 1 according to the invention is formed by folding and stacking the plurality of tissue papers 2 so that the tissue paper 2 is folded in half and outer folded sides 2B of the other tissue papers 2 located at the upper and lower positions are located at the inner folded side 2A and is a so-called pop-up type tissue paper bundle 3 in which one folded piece located at the uppermost position is pulled upward so that the other adjacent folded piece located therebelow is pulled and raised upward. The tissue paper bundle 3 can be manufactured with a known multi-stand type or rotary type inter folder.

On the other hand, the tissue paper bundle 3 according to the invention is formed in a substantially cuboid shape including a pair of longitudinal side surfaces 3B having arranged folded edges 2C of the tissue paper, a pair of short side surfaces 3A having no arranged folded edges 2C, and a pair of flat surfaces (upper and lower surfaces) 3C which is connected to the short side surface 3A and the longitudinal side surface 3B. Further, since the tissue paper bundle is formed by the flexible tissue paper 2, the tissue paper bundle is easily compressed and deformed due to the flexibility thereof.

The number of sets of the tissue papers 2 constituting the tissue paper bundle 3 is not limited, but is generally 120 to 240 sets in a tissue paper product when two plies (two stacked papers) are set as one set. Also in the film-packaged tissue 1 of the embodiment, the number can be set to 120 to 240 sets in this way.

Each of the tissue papers 2 constituting the bundle 3 of the tissue papers 2 has a ply structure in which two or three thin papers having crepes are stacked to forma set. The tissue paper 2 is of a dry type and is not a so-called wet type impregnated with a chemical liquid. Thus, the bundle 3 formed by the tissue papers 2 contains a lot of air. Furthermore, also in the dry type tissue paper 2, there is a chemical solution application type to which a moisturizing agent or the like is applied. However, the invention is particularly suitable for a non-moisturizing general tissue paper 2 to which a moisturizing agent or the like is not applied.

NBKP and LBKP are mixed as material pulp of thin paper constituting the tissue paper 2. Although used paper pulp may be mixed, it is better that material pulp to be consisted only of NBKP and LBKP from the viewpoint of texture and the like. As the mixture ratio, NBKP:LBKP=20:80 to 80:20 is desirable and NBKP:LBKP=30:70 to 60:40 is particularly desirable.

The basis weight per thin paper constituting each ply of the tissue paper 2 is 10 to 25 g/m$^2$. In the tissue paper 2 of the embodiment, a desirable general purpose type is 10 to 16 g/m$^2$. The basis weight herein means the basis weight obtained according to a measurement method of JISP 8124 (1998). Further, the paper thickness of the tissue paper 2 is 90 to 170 μm and more desirably 90 to 140 μm in a two-ply state. The paper thickness herein means a value which is measured in a two-ply state by a dial thickness gauge (thickness measuring instrument) "PEACOCK G type" (manufactured by OZAKI MFG. CO., LTD.) under the same condition after a test piece is sufficiently conditioned according to JIS P 8111 (1998).

The packaging form of the film-packaged tissue 1 according to the invention is selected from known packaging species. For example, three-way closed packaging, four-way closed packaging, gusset packaging, or pillow packaging can be exemplified. Gusset packaging and pillow packaging are suitable. In particular, pillow packaging with gussets is shown in the drawing. Particularly, this is pillow packaging with gussets in which a thermal bonded portion 30 formed by thermally bonding an overlapping portion of the packaging film is located at a position facing the short side surface 3A having no arranged folded edges 2C of the tissue papers 2 of the tissue paper bundle 3.

On the other hand, in the film-packaged tissue 1 of the embodiment, an opening perforation 5 is formed at a position facing the uppermost tissue paper 2 of the bundle 3 of the packaging film 4. The opening perforation 5 may be formed in a linear shape, but may be formed in an annular shape as shown in the drawing to form an elongated opening. Furthermore, the opening perforation 5 may be covered with a peelable sealant. In the embodiment, since the tissue paper bundle 3 is of a pop-up type, when the uppermost tissue paper 2 of the bundle 3 is pulled out by the opening formed as described above, a part of the next tissue paper located therebelow at the closest position is exposed from the opening.

As a specific flexible resinous film material constituting the packaging film 4, a single layer film of a polyethylene film, a polypropylene film, a polyester film, a polyethylene terephthalate film, a nylon film, a vinylidene chloride film, or an ethylene vinyl alcohol copolymer, an appropriately laminated film including these films, or a gas barrier film obtained by performing a surface treatment such as aluminum vapor deposition on these films can be exemplified. However, a polypropylene film or a polyethylene film is suitable from the viewpoint of cost. The thickness of the film material is appropriately selected in consideration of flexibility, cost, gas permeability, and thermal bonding property during packaging.

Here, in the film-packaged tissue 1 according to the invention, air vents 6, 6 . . . capable of discharging a gas inside a package to the outside of the package, guiding a gas outside the package to flow into the package, and communicating the inside and the outside of the package are formed at positions facing the short side surface 3A having no arranged folded edges 2C of the tissue paper bundle 3 of the packaging film 4. The air vent 6 is formed by a hole or a notch. In the embodiment shown in the drawings, the air vent 6 is formed by a substantially semi-circular notch. Furthermore, it is desirable to form the air vent by a notch rather than a circular hole in that dirt or dust hardly enters the package. Since the air vent 6 is formed, when the film-packaged tissue 1 according to the invention is compressed particularly in the plane direction (also referred to as compaction operation), that is, the stacking direction Y of the tissue paper 2, air inside the tissue paper bundle 3 is promptly discharged to the outside of the package and hence the web bulk (web height) can be promptly decreased. On the other hand, when the compression is cancelled, the web bulk is promptly returned. When describing this mechanism, the pop-up type tissue paper bundle 3 according to the invention includes the longitudinal side surface 3B having arranged folded edges 2C of the tissue papers 2 and the short side surface 3A having no arranged folded edges 2C. However, when the tissue paper bundle is compressed in the stacking direction Y of the tissue paper 2 as described above, air inside the tissue paper bundle 3 is directed to each of the side surfaces 3A and 3B. At this time, in the longitudinal side surface 3B, such air enters the inner folded side 2A of the tissue paper 2 and cannot be discharged to the outside of the bundle 3. However, since the folded edges 2C are not arranged in the short side surface 3A, air is promptly discharged to the outside of the tissue paper bundle 3. That is, when the tissue paper bundle is compressed from the stacking direction Y of the tissue paper 2, air is discharged faster and more from the short side surface 3A. Thus, since the air vent 6 exists at a position facing the short side surface 3A, when the tissue paper bundle 3 is compressed in the stacking direction Y of the tissue paper 2, it is possible to extremely promptly reduce the web bulk in a compact size. In contrast, when the compression operation is cancelled, the web bulk is promptly restored since air enters from the short side surface also in the tissue paper bundle 3 even when air promptly flows into the package.

Further, the number of the air vents 6 is not limited to one and can be plural. Further, the air vents may be provided only at positions facing one short side surface 3A of the pair of short side surfaces 3A or may be provided at position facing both short side surfaces. Desirably, the air vents are formed at positions facing both of the pair of short side surfaces 3A and 3A. In this structure, the exhaust/intake operation can be more promptly performed. Further, the size and number of the air vent 6 are appropriate design matters.

Figure 3:
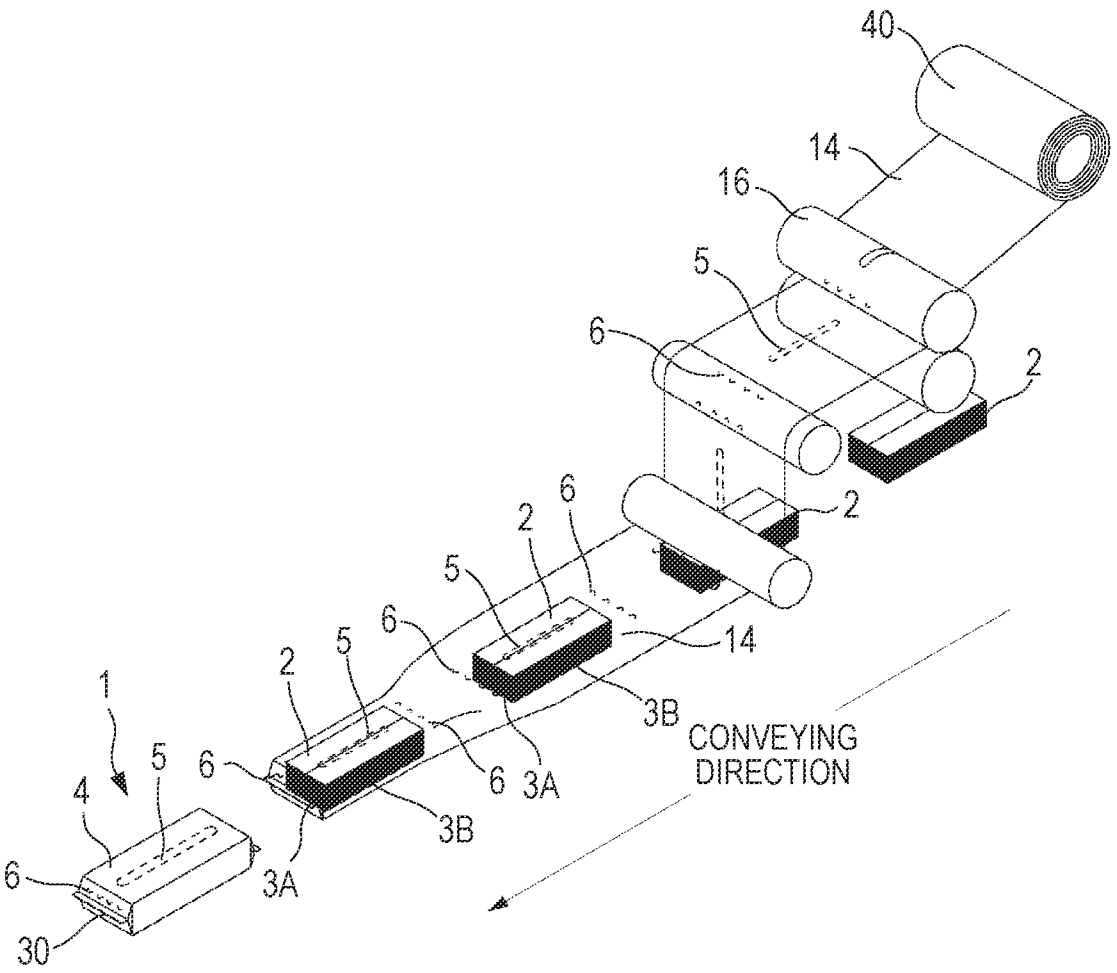
FIG. 3 is a diagram illustrating a manufacturing method for the film-packaged tissue of the invention.
Figure 4:
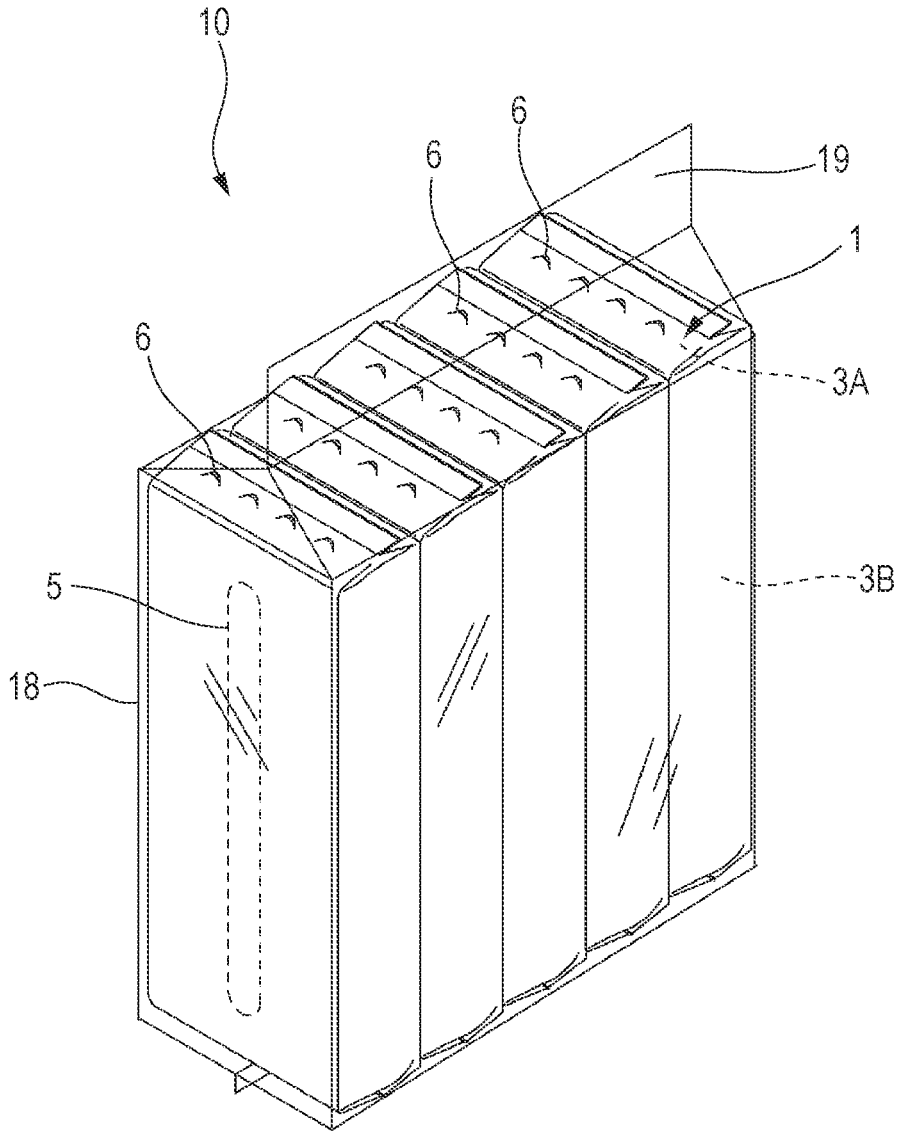
FIG. 4 is a diagram illustrating a film-packaged tissue set package according to the invention.
Figure 5:
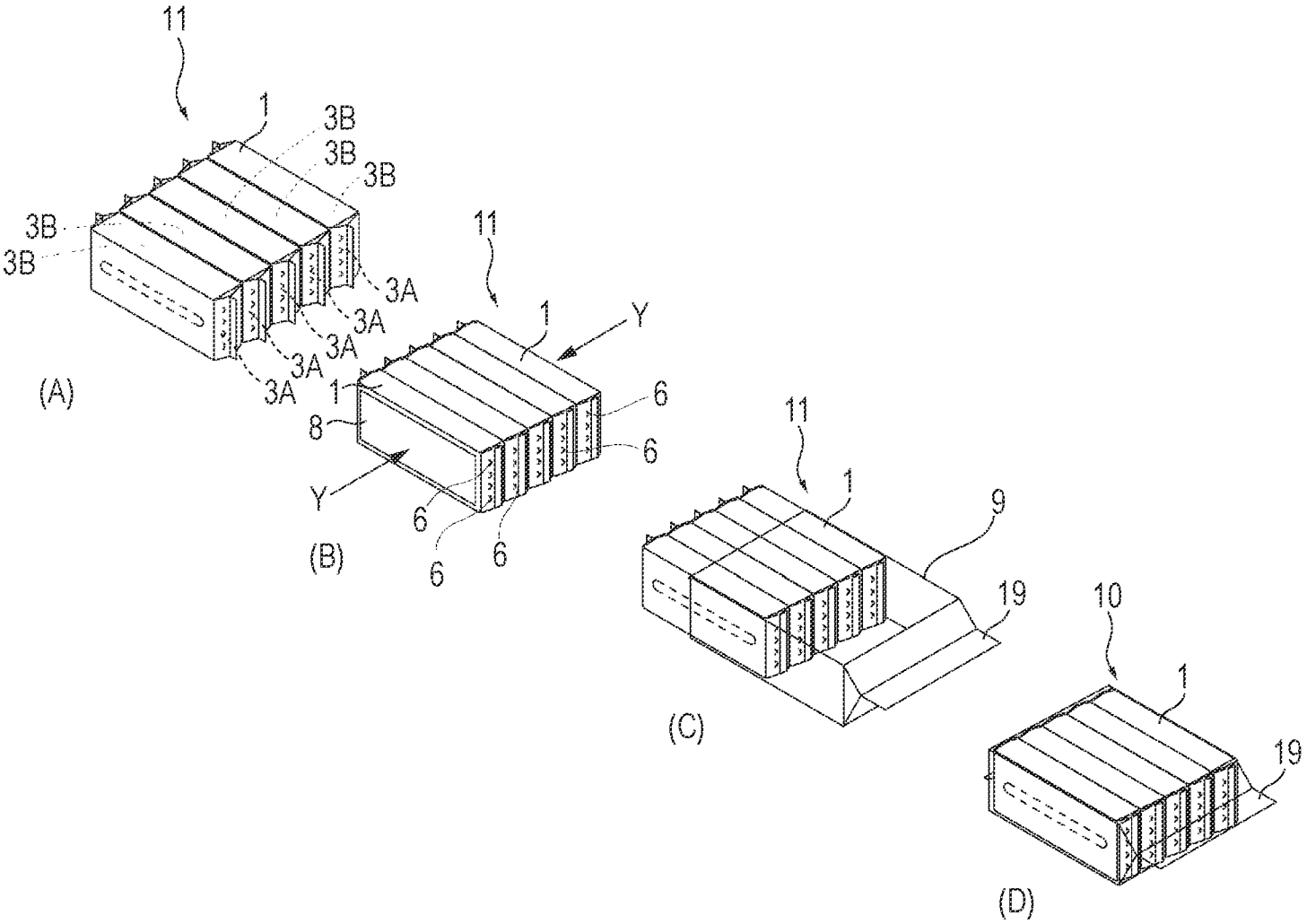
FIG. 5 is a diagram illustrating a manufacturing method for the film-packaged tissue set package according to the invention.

Here, the film-packaged tissue 1 provided with the air vent 6 according to the invention can be manufactured particularly as shown in FIG. 3. First, as described above, the pop-up type tissue paper bundle 3 having a substantially cuboid shape is formed by folding and stacking the plurality of tissue papers 2 so that the tissue paper 2 is folded in half and the outer folded sides 2B of the other tissue papers 2 located at the upper and lower positions are located at the inner folded side 2A by the multi-stand type or rotary type inter folder (a tissue paper bundle forming step).

Next, the tissue paper bundle 3 is conveyed with the short side surface 3A having no arranged folded edges 2C of the tissue papers 2 in the front to back direction. This conveying operation can be performed by a conveyor belt or the like. At the same time, a continuous packaging film 14 is reeled out from a web roll 40 on which the continuous elongated packaging film 14 is wound and a hole or a notch corresponding to the air vent 6 is formed in the conveyed continuous packaging film 14 at a predetermined interval by a die cut roll 16 (a hole forming step). Here, the opening perforation 5 corresponding to an outlet opening forming portion of the tissue paper 2 is desirably formed between the air vents 6 by the same die cut roll 16 as the die cut roll 16 forming the air vent 6. In order to form the air vent 6 and the opening perforation 5 by the die cut roll 16, a pattern of a cutter blade of the peripheral surface of the die cut roll may be appropriately formed by a known technique.

Then, the tissue paper bundle 3 is located between the air vents 6 and 6 of the continuous packaging film while conveying the tissue paper bundle 3 so that the conveying direction of the tissue paper bundle 3 is aligned to the conveying direction of the continuous packaging film 14, the tissue paper bundle 3 is wrapped by wrapping the edge portion of the continuous packaging film 14, the packaging film is thermally bonded at a position where the air vent 6 remains at a position facing the short side surface 3A of the tissue paper bundle 3, and then the packaging film is trimmed at the same timing as the thermal bonding process or after the thermal bonding process to obtain an individual package (a packaging step). It is more desirable to form a gusset on the longitudinal side surface of the tissue paper during the thermal bonding to form a gusseted pillow package.

In the film-packaged tissue 1 according to the invention, the opening perforation 5 and the air vent 6 can be continuously formed by using the die cut roll 16 and mass production can be performed efficiently.

On the other hand, in the film-packaged tissue 1 according to the invention, it is possible to promptly reduce the web bulk by promptly discharging air inside the tissue paper bundle 3 from the air vent 6 to the outside of the package in accordance with the compression operation from the stacking direction Y of the tissue paper 2 and to promptly restore the web bulk by promptly taking air from the outside of the package into the tissue paper bundle 3 in accordance with the compression canceling operation as described above.

For this reason, the film-packaged tissue 1 according to the invention can be provided as the film-packaged tissue set package 10 which is difficult to be compressed. That is, the pop-up type tissue paper bundle 3 having a substantially cuboid shape formed by folding and stacking the plurality of tissue papers 2 so that the tissue paper 2 is folded in half and the outer folded sides 2B of the other tissue papers located at the upper and lower positions are located at the inner folded side 2A can be provided in such a manner that the plurality of film-packaged tissue papers 1 which are packaged by the flexible resinous packaging film 4 and in which the air vents 6, 6 . . . capable of discharging a gas inside the package to the outside of the package and communicating the inside and the outside of the package are formed at positions facing the short side surface 3A having no arranged folded edges 2C of the tissue paper bundle 3 are formed as the film-packaged tissue set 11 having a substantially cuboid shape so that the longitudinal side surfaces 3B having arranged folded edges 2C and the short side surfaces 3A having no arranged folded edges 2C are respectively aligned and the film-packaged tissue set 11 is subjected to the gusset packaging by the film while being compressed in the stacking direction Y of the tissue paper 2. The film 18 used for the gusset packaging can be selected from the films similar to the above-described packaging film 4.

Since the film-packaged tissue set package 10 is compressed in the stacking direction Y of the tissue paper 2, the rigidity of the web can be improved. Further, since the tissue paper bundle 3 is formed in a substantially cuboid shape so that the short side surfaces 3A, 3A . . . and the longitudinal side surfaces 3B, 3B . . . of the plurality of film-packaged tissues 1 are respectively aligned, the area of each surface is wide and is excellent in standing stability when each surface is taken as the bottom surface as compared to the individual film-packaged tissue 1. That is, the film-packaged tissue set package 10 is a form suitable for selling while being piled up and sold in large quantities at a shop. In particular, the gusset packaging means that a handle portion 19 is formed at one short side surface side. Therefore, it is possible to secure excellent handling and portable properties.

Here, in order to allow the compression operation only in the stacking direction Y of the tissue paper 2 particularly as in the film-packaged tissue set package 10 according to the invention, the gusset packaging may be performed by using an one-side closed bag of this shape or a tubular film 9 (also called a gusset tube) with both open ends. Hereinafter, a manufacturing method for the film-packaged tissue set package 10 according to the invention will be further described. First, the film-packaged tissue 1 in which the air vent is formed at a position facing the short side surface according to the invention is manufactured as described above. Subsequently, particularly as shown in FIG. 5(A), the film-packaged tissue set 11 having a substantially cuboid shape is formed by arranging the plurality of (five in the example shown in the drawing) film-packaged tissues 1 so that the longitudinal side surfaces 3B having arranged folded edges 2C and the short side surfaces 3A having no arranged folded edges 2C are flush with one another. The set 11 can be formed while being appropriately arranged on a conveyor belt. Then, as shown in FIG. 5(B), a pressing member 8 is brought into contact with the pair of film-packaged tissues 1 located at both ends of the film-packaged tissue set 11 and the set 11 is compressed from the stacking direction Y of the tissue paper 2. The pressing member 8 can be exemplified as a pressing plate or a pressing roll. Then, air inside the package is discharged from the air vents 6 formed in the film-packaged tissues 1, 1 . . . during the compression of the pressing member 8 (a compression step). A desirable compression rate is 60 to 70%. That is, the compression operation is performed so that the web bulk (the stacking height) becomes 60 to 70%. Subsequently, as shown in FIG. 5(C), the film-packaged tissue set 11 compressed in the stacking direction of the tissue paper 2 is inserted into an one-side closed bag 9 or a tubular film with both end openings which is the precursor of the gusset packaging bag of a size in which the compression state is maintained so that the compression operation by the pressing member 8 is cancelled. When the compression is cancelled, each film-packaged tissue 1 tries to be restored so that the web bulk is returned, but the film-packaged tissue is restrained so as not to be completely restored by the bag 9 or the tubular film. Then, as shown in FIG. 5(D), the opening of the bag 9 or the tubular film is sealed and the film-packaged tissue set 11 is subjected to the gusset packaging while being compressed in the stacking direction Y of the tissue paper 2. The set package 11 can excellently maintain its shape since the set is subjected to the gusset packaging in a compression state in which the restoring force of each film-packaged tissue 1 is maintained. Here, tissue paper products which are piled up at a shop need 35 to 50 set productivity per minute. Then, in order to maintain such productivity, there is a need to perform a series of operations from the operation of compressing the film-packaged tissue set package 10 according to the invention to the operation of inserting the package into the gusset tube 9 for about 1 to 2 seconds. The film-packaged tissue 1 according to the invention can be subjected to the gusset packaging without worrying about the breakage of the package even when the compression operation is performed in a short time.

Here, when describing desirable example in detail, the film-packaged tissue 1 has a general size in which a short length×a web height is 100 mm×40 mm. Thus, when the set is formed by five film-packaged tissues, the circumferential length becomes 600 mm. When the set is compressed to, for example, 62.5%, each film-packaged tissue substantially has a size in which a short length×a web height is 100 mm×25 mm and the circumferential length of the set formed by five film-packaged tissues becomes 450 mm. Then, when the set which is compressed in this way is inserted into a bag or a tubular film (a gusset tube) having an inner circumferential length of 550 mm and the compression is cancelled, the circumferential length of the set formed by five film-packaged tissues is restored to 550 mm and the set is subjected to the gusset packaging in a compression state in which a restoring force is maintained.

In this way, since the film-packaged tissue set package has a shape and a strength suitable for selling while being piled up at a shop and can be manufactured in a large quantity, large-scale sales of film-packaged tissues will be easy.

The invention claimed is:

1. A film-packaged tissue paper, comprising:

a pop-up type tissue paper bundle having a substantially cuboid shape and formed by folding and stacking a plurality of tissue papers so that the tissue paper is folded in half and outer folded sides of the other tissue papers located at upper and lower positions are located at an inner folded side is packaged with a flexible resinous packaging film, wherein a plurality of air vents extend in a first direction communicating the inside and the outside of a package are formed at a position facing a plurality of short side surfaces having no arranged folded edges of the tissue paper bundle of the packaging film; and an elongated opening extending in a second direction on a top surface in between the short side surfaces, wherein the second direction of the elongated opening is perpendicular to the first direction of the plurality of air vents.

2. A film-packaged tissue set package, comprising:

a plurality of film-packaged tissue papers in which a pop-up type tissue paper bundle having a substantially cuboid shape and formed by folding and stacking a plurality of tissue papers so that the tissue paper is folded in half and outer folded sides of the other tissue papers located at upper and lower positions are located at an inner folded side is packaged with a flexible resinous film and in which a plurality of air vents extend in a first direction communicating the inside and the outside of the package are formed at a position facing each of a plurality of short side surfaces having no arranged folded edges of the tissue paper bundle are provided as a film-packaged tissue set in a substantially cuboid shape so that a plurality of longitudinal side surfaces having arranged folded edge and the short side surfaces having no arranged folded edges are respectively aligned and the film-packaged tissue set is subjected to gusset packaging while being compressed in the tissue paper stacking direction, and an elongated opening extending in a second direction on a top surface in between the short side surfaces, wherein the second direction of the elongated opening is perpendicular to the first direction of the plurality of air vents.

3. The film-packaged tissue set package according to claim 1, wherein the gusset packaging means that a handle portion is formed at one short side surface side.

* * * * *